United States Patent [19]

Ingerson

[11] Patent Number: 5,028,391

[45] Date of Patent: Jul. 2, 1991

[54] COPPER-NICKEL-SILICON-CHROMIUM ALLOY

[75] Inventor: Quentin F. Ingerson, Milwaukee, Wis.

[73] Assignee: Amoco Metal Manufacturing Inc., Milwaukee, Wis.

[21] Appl. No.: 457,013

[22] Filed: Dec. 26, 1989

Related U.S. Application Data

[63] Continuation of Ser. No. 345,113, Apr. 28, 1989, abandoned.

[51] Int. Cl.[5] ..... C22C 9/06; C22C 9/02; C22C 9/04

[52] U.S. Cl. ..... 420/488; 148/160; 148/412; 148/413; 148/414

[58] Field of Search ..... 420/488; 148/412, 413, 148/414, 160

[56] References Cited

U.S. PATENT DOCUMENTS

| | | | |
|---|---|---|---|
| 1,658,186 | 2/1928 | Corson | 148/160 |
| 1,763,303 | 6/1930 | Graham | 148/12.7 R |
| 1,778,668 | 10/1930 | Fuller | 420/488 |
| 3,072,508 | 1/1963 | Klement et al. | 148/160 |
| 4,191,601 | 3/1980 | Edens et al. | 148/160 |
| 4,260,435 | 4/1981 | Edens et al. | 148/32.5 |
| 4,728,372 | 3/1988 | Caron et al. | 148/2 |

FOREIGN PATENT DOCUMENTS

| | | |
|---|---|---|
| 456019 | 3/1975 | U.S.S.R. . |
| 1358055 | 6/1974 | United Kingdom . |

*Primary Examiner*—Richard O. Dean
*Assistant Examiner*—Robert R. Koehler
*Attorney, Agent, or Firm*—Andrus, Sceales, Starke & Sawall

[57] ABSTRACT

A copper-nickel-silicon-chromium alloy having the combination of high hardness and high electrical conductivity. The alloy is composed by weight of 9.5% to 11.5% nickel, in an amount sufficient to provide a nickel-silicon ratio of 3.4 to 4.5, 0.5% to 2.0% chromium, and the balance copper. The alloy is heat treated by initially heating the alloy to a solution temperature and is thereafter quenched. The quenched alloy is then aged to precipitate the metal silicides. Because of the specific ratio of nickel to silicon, the heat treated alloy develops during heat treatment a hardness in excess of 30 Rockwell C and an electrical conductivity in excess of 24% of pure copper.

11 Claims, 1 Drawing Sheet

COPPER-NICKEL-SILICON-CHROMIUM ALLOY

RELATED APPLICATION

This application is a continuation of application Ser. No. 07/345,113, filed Apr. 28, 1989 now abandoned.

BACKGROUND OF THE INVENTION

There is a continuing demand in industry for an alloy having the combination of high hardness and high electrical conductivity. These two properties are incongruous, since good conductivity is a property of pure metals, whereas high hardness is normally achieved by alloying the pure metal with one or more alloying elements.

Age or precipitation hardened copper-base alloys are well known. U.S. Pat. No. 1,658,186 discloses the precipitation hardening phenomenon in copper base alloys. More specifically, U.S. Pat. No. 1,685,186 describes a copper alloy containing silicon and one or more of a group of silicide forming elements, such as chromium, cobalt and nickel. The improved hardness is achieved by a heat treatment consisting of heating the alloy to a solution temperature, subsequently quenching the alloy to hold the bulk of the alloying elements in solid solution and thereafter aging the alloy to precipitate metallic silicides, resulting in an increase of hardness and an improvement in electrical conductivity.

U.S. Pat. No. 4,260,435 describes a precipitation hardened, copper base alloy, that is an improvement to the alloy described in U.S. Pat. No. 1,658,186. The alloy is composed of 2.0% to 3.0% nickel and/or cobalt, 0.4% to 0.8% silicon, 0.1% to 0.5% chromium, and the balance copper. The silicon, as disclosed in U.S. Pat. No. 4,260,435, is used in an amount slightly in excess of the stoichiometric amount necessary to form silicides of the nickel, thereby removing the nickel from solution and leaving excess silicon. The chromium is used in an amount slightly greater than the amount required to form chromium silicide with the excess silicon. Because of the low solubility of chromium in copper, the excess chromium will be precipitated by a second aging treatment.

With the double aging treatment, along with the chemistry, as set forth in U.S. Pat. No. 4,260,435, a heat treated alloy is obtained having a high hardness above 90 Rockwell B, along with a high electrical conductivity of over 45% of pure copper.

Copper-base alloys have desirable properties for use as components in blow molding dies, injection molding dies, reinforced composite dies or extruding dies for the plastic industry. Copper base alloys have lower machining costs, and offer excellent diffusivity, assuring better heat equalization of the die and reducing post die shrinkage and core warpage. However, there has been a need for a beryllium-free, copper-base die alloy hving a higher hardness, above 30 Rockwell C, while maintaining good electrical conductivity.

SUMMARY OF THE INVENTION

The invention is directed to a wrought or cast copper-nickel-silicon-chromium alloy having high hardness and high conductivity and has particular use as a component in injection, blow molding or extruding dies for the plastic industry.

In general, the alloy consists of 9.5% to 11.5% nickel, silicon in an amount sufficient to provide a nickel/silicon ratio of 3.4 to 4.5, 0.5% to 2.0% chromium, and the balance copper. With this specific nickel/silicon ratio, a high hardness above 30 Rockwell C is achieved, along with an electrical conductivity above 24% of pure copper, by a precipitation hardening treatment. In the heat treatment, the alloy is initially heated to an elevated solution temperature in the range of 1600° F. to 1850° F., quenched, and then age hardened at a temperature range of 650° F. to 1050° F.

As an alternate heat treatment, the solution quenched alloy is aged at a temperature of 900° F. to 1000° F. and then slowly cooled at a rate of 100° F. to 200° F. per hour to 650° F. This alternate heat treatment can increase the electrical conductivity to a value above that obtained by a single temperature aging treatment and provides a small increase in hardness.

It would normally be expected that a substantial increase in the nickel and silicon content in a copper-nickel silicon alloy would result in an increase in hardness, but the increase in nickel and silicon would also be expected to produce a dramatic decrease in electrical conductivity. However, it has been found that by maintaining the chemistry of the alloy within the above recited ranges, and maintaining the nickel/silicon ratio within a precise range, high hardness can be obtained without a corresponding dramatic decrease in conductivity.

The alloy of the invention has particulaer use as a die material for the molding or extrusion of plastic parts. The increase in hardness enables the alloy to withstand the high closing pressures without distortion and to resist erosion by the plastic material, particularly when the plastic may contain chopped fibrous material.

The alloy of the invention offers excellent thermal diffusivity, which is a measurement of the thermal conductivity, specific heat and density of the alloy. The high thermal diffusivity enables the alloy, when used as a die component, to "soak up" heat and reduces the time for cooling, thereby decreasing the cycle time for the mold casting and mold forming operations.

While the alloy has particular use as a component for a die, it can also be used for guide rails and pins, bushings, work plates, ejector pins, racks and the like.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

The alloy of the invention, which can either by wrought or cast, has the following composition in weight percent:

Nickel and/or Cobalt: 8.5% to 11.5%

Silicon in amount sufficient to provide a nickel/silicon ratio of 3.4 to 4.5

Chromium: 0.50% to 2.00%

Copper: Balance

In order to provide the optimum hardness and electrical conductivity, the nickel/silicon ratio should be maintained within precise limits. The nickel/silicon ratio should be present in the above range, and preferably in the range of 3.8 to 4.2.

The alloy can also include up to about 0.5% by weight of an element, such as zirconium, magnesium, tin, zinc, aluminum, or the like. A small amount of zirconium can have the benefit of improving the elevated temperature ductility of the alloy.

The alloy is heat treated by initially heating to an elevated temperature in the range of 1600° F. to 1850° F. for 1 to 2 hours to ensure maximum solubility of the alloying elements. The alloy is quenched, preferably in water, to obtain a solid solution of the alloying elements at room temperature. The alloy is age hardened by reheating to a temperature in the range of 650° F. to 1050° F. for a period of about 1 to 5 hours, and preferably 3 hours. During the aging treatment the metal silicides precipitate as submicroscopic particles, which increases the hardness of the alloy to a value in excess of 30 Rockwell C, while the electrical conductivity is maintained at a value above 24% of pure copper and preferably in the range of 26% to 28%.

Alternately, the solution quenched alloy can be aged at 900° F. to 1000° F. for 1 to 3 hours and cooled at a rate of 100° F. to 200° F. per hour to 650° F. The slowly cooled aging heat treatment significantly increases the electrical conductivity of the alloy to values greater than those obtained by single temperature age and gives a small increase in hardness.

The alloy, as heat treated, has a thermal conductivity in excess of 100/watts/meter/°K, a tensile strength in the range of 125,000 to 140,000 psi, a 0.2% offset yield strength of 110,000 to 120,000 psi, and an elongation of 5% to 15%.

Figure 2:
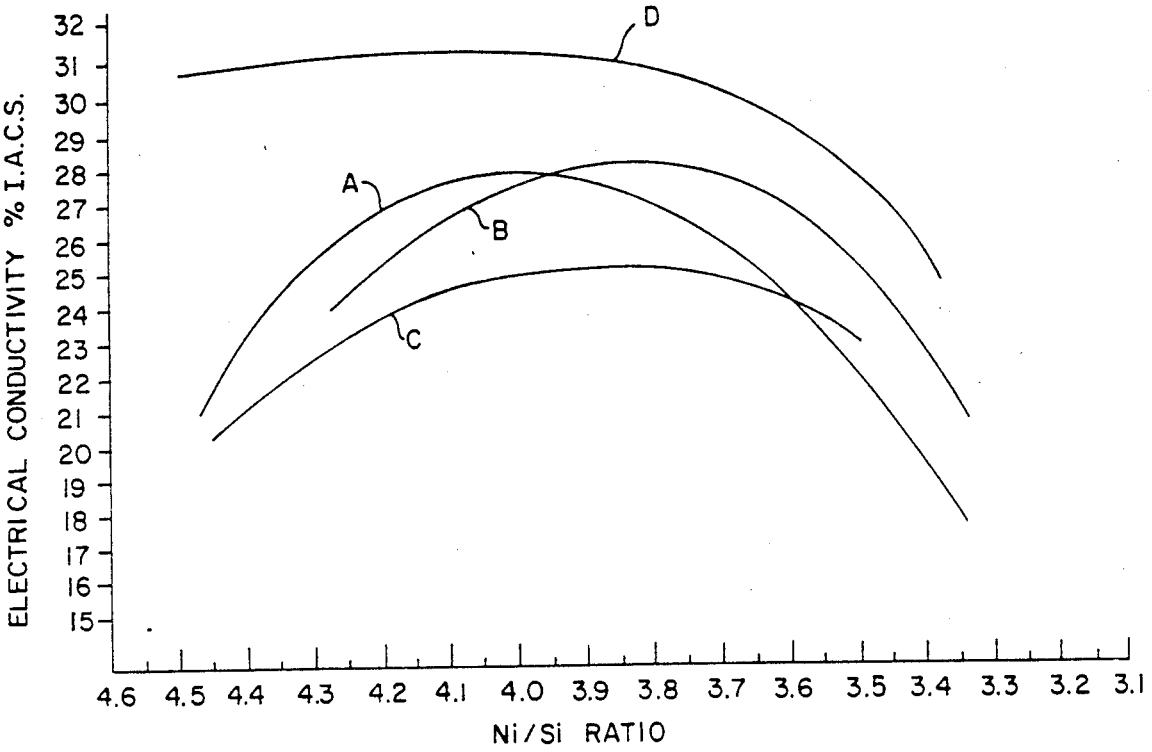
FIG. 2 is a graph comparing the electrical conductivity of the alloy with variations in the nickel/silicon ratio.
Figure 1:
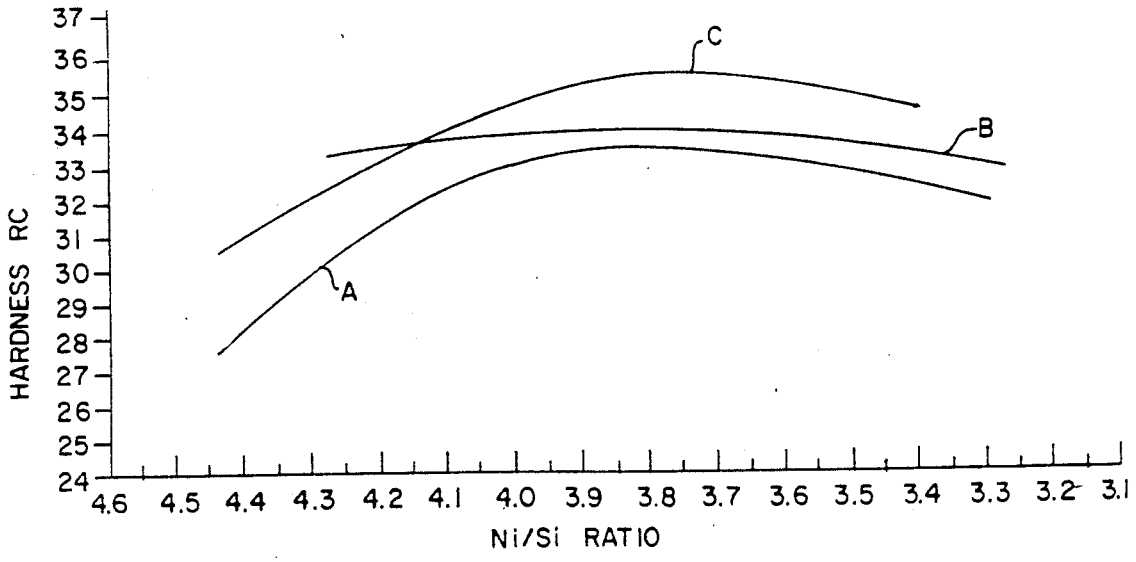
FIG. 1 is a graph comparing the hardness of the alloy in Rockwell C with variations in the nickel/silicon ratio.

FIG. 1 shows the relationship of variations in the nickel/silicon ratio to hardness, while FIG. 2 shows the relationship of variations in the nickel/silicon ratio to electrical conductivity.

Referring to FIGS. 1 and 2, the curve labeled A is a copper-nickel-silicon-chromium alloy containing 10.0% nickel, 1.5% chromium, and the silicon was varied in different heats to provide a nickel/silicon ratio from between 3.4 to 4.5.

Curve B is a copper-nickel-silicon-chromium alloy containing 8.5% nickel, 1.6% chromium, and the silicon content was varied in different heats to provide a nickel/silicon ratio from 3.4 to 4.3.

Curve C is an alloy containing 11.2% nickel, 1.65% chromium and again the silicon content was varied to provide a nickel/silicon ratio in different heats from 3.5 to 4.5.

Each alloy A–C was heat treated by heating to a solution temperature of 1750° F. and the alloy was held at this temperature for 1 hour. The alloy was then quenched and subsequently aged at a temperature of 875° F. for a period of 3 hours.

As can be seen from FIG. 1, alloys A, B and C each have a hardness above 32 Rockwell C when the nickel/silicon ratio is maintained in the range of 3.6 to 4.1. As the ratio increases above 4.1, the hardness of both alloys A and C drops off significantly.

With regard to electrical conductivity, as shown in FIG. 2, alloys A and B show a conductivity in excess of 27% with a nickel/silicon ratio of 3.8 to 4.1. As the ratio decreases below 3.8, the conductivity falls off rapidly.

Alloy C has an electrical conductivity above 25% with a nickel/silicon ratio of approximately 3.8 to 4.1. As the ratio falls outside of this range, the electrical conductivity again falls off.

The curve D is a composite of electrical conductivity values of the three alloys A, B and C, which were subjected to the alternate heat treatment. In this treatment the as-cast alloy was initially heated to 1800° F. and held at that temperature for 1 hour. The alloy was then quenched and subsequently aged at 950° F. for 1.5 hours, followed by slow cooling at a rate of 200° F. per hour to 650° F.

The plotted curve D shows that the electrical conductivity of all three alloys A, B and C was substantially increased while the hardness values, as plotted in FIG. 1, were not significantly affected. More particularly, the alternate heat treatment increased the conductivity of the three alloys to a value above 30% at a nickel/silicon ratio of about 3.7 to 4.5.

From the data shown in FIGS. 1 and 2, it can be seen that a nickel-silicon ratio in the range of 3.4 to 4.5 unexpectedly provides the optimum hardness, as well as good electrical conductivity. As the nickel/silicon ratio varies outside of this range, the hardness and conductivity drops off significantly.

The alloy of the invention has particular application as a die component for blow molding, injection molding, composite molding and extruding plastic materials. Due to the high diffusivity, improved heat equalization of the die component is assured, which results in reduced cooling time.

As the alloy has a high hardness above 30 Rockwell C, it is capable of withstanding the high closing pressures during the die casting operation without distortion. Further, the high hardness resists erosion by the plastic material and this is of particular concern when the plastic material includes chopped fibrous substances.

Various modes of carrying out the invention are contemplated as being within the scope of the following claims particulary pointing out and distinctly claiming the subject matter which is regarded as the invention.

I claim:

1. A solution treated precipitation hardened copper base alloy consisting essentially by weight of 9.5% to 11.5% nickel, silicon in an amount sufficient to provide a nickel/silicon ratio in the range of 3.4 to 4.5, 0.50% to 2.00% chromium, and the balance copper, said alloy having a hardness in excess of 30 Rockwell C and an electrical conductivity in excess of 24% of pure copper.

2. The alloy of claim 1, wherein said alloy also includes up to 0.5% by weight of an element selected from the group consisting of zirconium, magnesium, tin, zinc, aluminum and mixtures thereof.

3. The alloy of claim 1, wherein cobalt is substituted for at least a portion of said nickel.

4. The alloy of claim 1, wherein said alloy has a nickel/silicon ratio in the range of 3.8 to 4.2.

5. A method of forming a copper base alloy, comprising the steps of preparing an alloy consisting essentially by weight of 9.5% to 11.5% nickel, silicon in an amount sufficient to provide a nickel/silicon ratio in the range of 3.4 to 4.5, 0.50% to 2.00% chromium, and the balance copper, heating the alloy to a solution temperature, quenching the alloy, re-heating the alloy to an aging temperature in the range of 900° F. to 1000° F., and thereafter slowing cooling the alloy to a temperature of 650° F. at a rate of 100° F. to 200° F. per hour to thereby provide a heat treated alloy having a hardness in excess of 30 Rockwell C and an electrical conductivity in excess of 24% of pure copper.

6. The method of claim 5, wherein said solution temperature is in the range of 1600° F. to 1850° F.

7. The method of claim 6, and including the step of holding the alloy at said solution temperature for a period of 1 to 5 hours.

8. The method of claim 5, and including the step of holding the alloy at said aging temperature for a period of 1 to 3 hours.

9. A copper base alloy consisting essentially by weight of 9.5% to 11.5% nickel, silicon in an amount sufficient to provide a nickel/silicon ratio in the range of 3.4 to 4.5, 0.50% to 2.00% chromium, and the balance copper, said alloy having a hardness in excess of 30 Rockwell C and an electrical conductivity in excess of 24% of pure copper, said alloy being produced by heating the alloy to a solution temperature, quenching the alloy, re-heating the alloy to an aging temperature in the range of 900° F. to 1000° F., and thereafter slowing cooling the alloy to a temperature below 650° F. at a rate of 100° F. to 200° F. per hour.

10. A method of forming a copper base alloy, comprising the steps of preparing an alloy consisting essentially by weight of 9.5% to 11.5% nickel, silicon in an amount sufficient to provide a nickel/silicon ratio in the range of 3.4 to 4.5, 0.50% to 2.0% chromium, and the balance copper, heating the alloy to a solution temperature, quenching the alloy, re-heating the alloy to an aging temperature in the range of 650° F. to 1050° F. and thereafter cooling the alloy to thereby provide a heat treated alloy having a hardness in excess of 30 Rockwell C and an electrical conductivity in excess of 24% of pure copper.

11. A copper base alloy consisting essentially by weight of 9.5% to 11.5% nickel, silicon in an amount sufficient to provide a nickel/silicon ratio in the range of 3.4 to 4.5, 0.50% to 2.0% chromium, and the balance copper, said alloy having a hardness in excess of 30 Rockwell C and an electrical conductivity in excess of 24% of pure copper, said alloy being produced by heating the alloy to a solution temperature, quenching the alloy, re-heating the alloy to an aging temperature in the range of 650° F. to 1050° F. and thereafter cooling the alloy.

* * * * *